US008096238B2

(12) United States Patent
Rehm et al.

(10) Patent No.: US 8,096,238 B2
(45) Date of Patent: Jan. 17, 2012

(54) SATELLITE PRINTING UNIT OF A WEB-FED PRINTING PRESS

(75) Inventors: Marc Rehm, Waiblingen (DE); Helmut Stuhlmiller, Altenmuenster (DE)

(73) Assignee: Man Roland Druckmaschinen AG, Augsburg (DE)

( * ) Notice: Subject to any disclaimer, the term of this patent is extended or adjusted under 35 U.S.C. 154(b) by 583 days.

(21) Appl. No.: 12/037,628

(22) Filed: Feb. 26, 2008

(65) Prior Publication Data

US 2008/0210112 A1 Sep. 4, 2008

(30) Foreign Application Priority Data

Mar. 3, 2007 (DE) ..... 10 2007 010 358

(51) Int. Cl.
*B41F 7/02* (2006.01)

(52) U.S. Cl. ..... 101/217; 101/381

(58) Field of Classification Search ..... 101/378, 101/217, 415.1
See application file for complete search history.

(56) References Cited

U.S. PATENT DOCUMENTS 4,671,501 A * 6/1987 Fujishiro ..... 270/21.1
5,429,051 A * 7/1995 Laubscher ..... 101/417
5,481,973 A * 1/1996 Schmid ..... 101/216
6,408,747 B2 * 6/2002 Koppelkamm et al. ..... 101/147
2004/0020383 A1 * 2/2004 Stiel ..... 101/180
2004/0231535 A1 * 11/2004 Gerner et al. ..... 101/217
2004/0244615 A1 * 12/2004 Herbert et al. ..... 101/227
2004/0250717 A1 * 12/2004 Masuch et al. ..... 101/179
2005/0199147 A1 * 9/2005 Schafer et al. ..... 101/415.1
2006/0230954 A1 * 10/2006 Albrecht et al. ..... 101/217
2006/0230955 A1 * 10/2006 Albrecht et al. ..... 101/217

FOREIGN PATENT DOCUMENTS

DE 102 49 947 A1 5/2004
DE 200 23 414 U1 4/2005
DE 203 20 937 U1 7/2005

* cited by examiner

*Primary Examiner* — Ren Yan
*Assistant Examiner* — David Banh
(74) *Attorney, Agent, or Firm* — Crowell & Morning LLP

(57) ABSTRACT

A satellite printing unit of a web-fed printing press with printing couples is disclosed. Each printing couple includes a plate cylinder and a transfer cylinder where the transfer cylinders of all the printing couples roll off a common impression cylinder. Each plate cylinder features a high lockup slot and a low lockup slot and each transfer cylinder has a lockup slot. The transfer cylinders of the printing couples are aligned relative to the plate cylinders of the printing couples such that, on a first group of printing couples, which includes at least one printing couple, the lockup slot of the respective transfer cylinder rolls over the high lockup slot of the respective plate cylinder and on a second group of printing couples, which includes at least one printing couple, the lockup slot of the respective transfer cylinder rolls over the low lockup slot of the respective plate cylinder.

9 Claims, 2 Drawing Sheets

SATELLITE PRINTING UNIT OF A WEB-FED PRINTING PRESS

This application claims the priority of German Patent Document No. 10 2007 010 358.3, filed Mar. 3, 2007, the disclosure of which is expressly incorporated by reference herein.

BACKGROUND AND SUMMARY OF THE INVENTION

The invention relates to a satellite printing unit of a web-fed printing press.

Satellite printing units of web-fed printing presses known from practice have several printing couples, wherein each printing couple features a transfer cylinder, a plate cylinder, an inking system as well as, if applicable, a dampening system. The plate cylinders are also designated as engraving cylinders and the transfer cylinders are also called blanket cylinders. In addition, these types of satellite printing units feature at least one impression cylinder, wherein the, or each, impression cylinder cooperates with several transfer cylinders of different printing couples. Satellite printing units with four printing couples and one impression cylinder are also designated as 9-cylinder satellite printing units, whereby, in the case of such 9-cylinder satellite printing units, the transfer cylinders of all the printing couples cooperate with one single impression cylinder.

Transfer plates are clamped on the transfer cylinders of the printing couples and printing plates are clamped on the plate cylinders. Lockup slots allocated to the cylinders are used for this. Each plate cylinder of the printing couples is allocated two lockup slots, namely a high lockup slot and a low lockup slot, which are approx. diametrically opposed on the circumference of the plate cylinder, so that, as viewed in the circumferential direction of the plate cylinder, two printing plates can be clamped in succession on the respective plate cylinder. As already stated, each transfer cylinder of the printing couples also has a lockup slot so that, as viewed in the circumferential direction of the transfer cylinder, a transfer plate can be clamped on the respective transfer cylinder.

In the case of satellite printing units known from practice, the transfer cylinders of the printing couples are aligned relative to the plate cylinders of the printing couples in such a way that, in the region of each printing couple, the lockup slot of the respective transfer cylinder rolls over the low lockup slot of the corresponding plate cylinder. This applies to printing units known from practice regardless of whether the lockup slots of the respective cylinders are undivided or divided over the axial width of the cylinders.

Starting herefrom, the present invention is based on the objective of creating a novel satellite printing unit of a web-fed printing press. According to the invention, transfer cylinders of the printing couples are aligned relative to the plate cylinders of the printing couples in such a way that, on a first group of printing couples, which is comprised of at least one printing couple, the lockup slot of the respective transfer cylinder rolls over the high lockup slot of the respective plate cylinder, and that, on a second group of printing couples, which is comprised of at least one printing couple, the lockup slot of the respective transfer cylinder rolls over the low lockup slot of the respective plate cylinder.

The present invention provides for the first time a satellite printing unit, in which the transfer cylinders of the printing couples are aligned asymmetrically relative to the plate cylinders of the printing couples in such a way that, on the first group of printing couples, the lockup slot of the respective transfer cylinder rolls over the high lockup slot of the respective plate cylinder, and that, on the second group of printing couples, the lockup slot of the respective transfer cylinder rolls over the low lockup slot of the respective plate cylinder. This makes it possible to improve the smoothness of running the cylinders, particularly the impression cylinder. The cylinders, particularly the impression cylinder, are excited to fewer vibrations so that the print quality can be improved.

Preferred developments of the invention are yielded from the following description. Without being limited hereto, exemplary embodiments of the invention are explained in greater detail on the basis of the drawings.

DETAILED DESCRIPTION OF THE DRAWINGS

A satellite printing unit known from the prior art will be described in reference to FIG. 1 in the following before a satellite printing unit of a web-fed rotary printing press of the present invention is described in detail in reference to FIG. 2.

Figure 1:
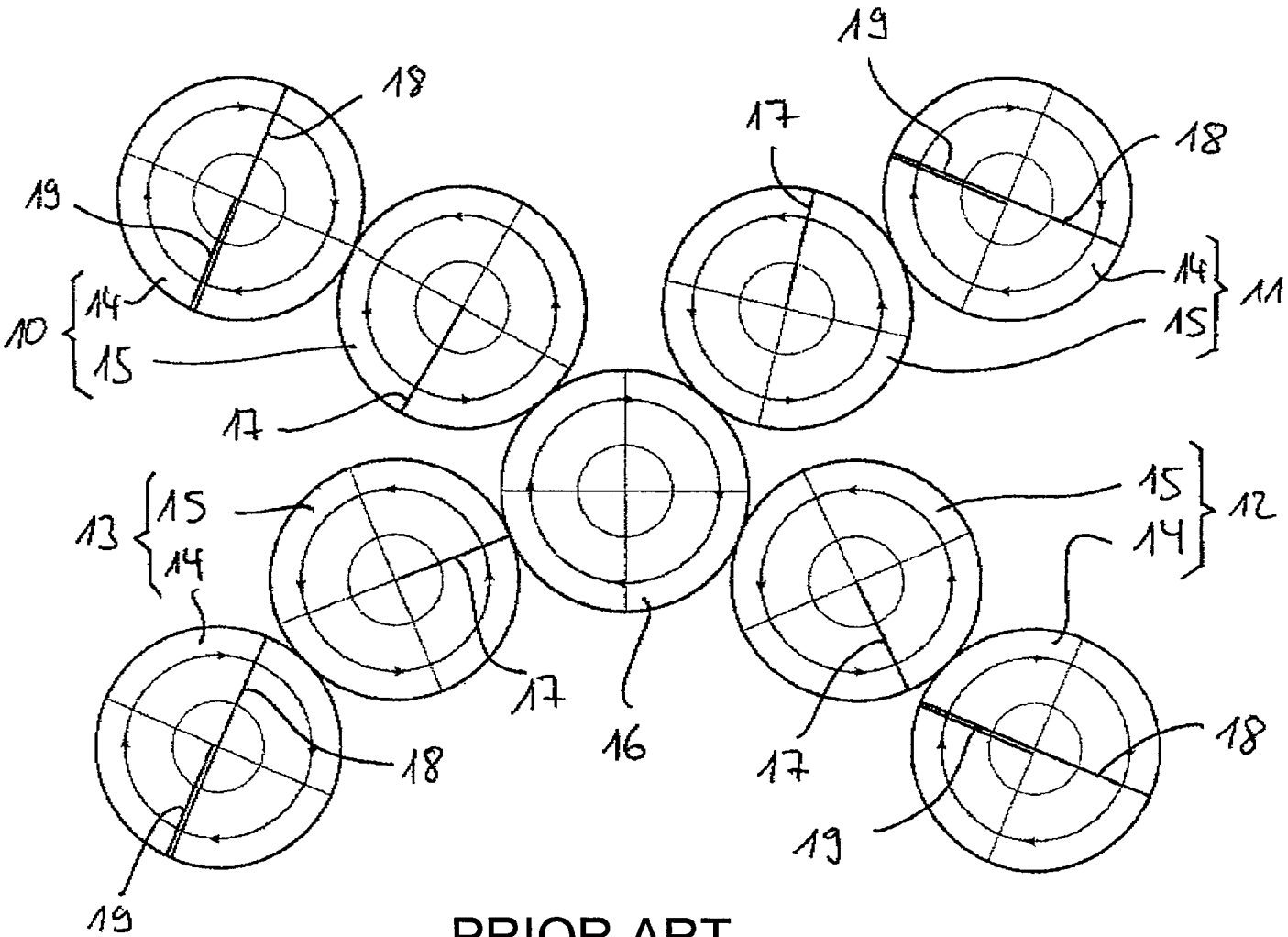
PRIOR ART Fig. 1
FIG. 1 illustrates a prior art satellite printing unit of a web-fed rotary printing press.

FIG. 1 shows a schematic representation of a satellite printing unit known from the prior art, whereby, according to FIG. 1, the satellite printing unit is comprised of a total of four printing couples 10, 11, 12 and 13. Each of the printing couples 10, 11, 12 and 13 has a plate cylinder 14 as well as a transfer cylinder 15 rolling off the plate cylinder. The plate cylinders are also designated as engraving cylinders and the transfer cylinders are also called blanket cylinders. In addition, each printing couple 10, 11, 12 and 13 includes an inking system (not shown) as well as, if applicable, a dampening system (also not shown).

The transfer cylinders 15 of all the printing couples 10, 11, 12 and 13 roll off a common impression cylinder 16 forming nips, through which a print substrate web that is to be printed can be conveyed. The satellite printing unit in FIG. 1 is therefore designed as a 9-cylinder satellite printing unit.

Transfer plates can be clamped on the transfer cylinders 15 of the printing couples 10, 11, 12 and 13, whereby each transfer cylinder 15 has a lockup slot 17 for this. As seen in the circumferential direction of each transfer cylinder 15, one transfer plate respectively can be clamped on the transfer cylinder 15 in the lockup slot 17 and, as viewed in the axial direction, at least one transfer plate can be clamped on the transfer cylinder 15 in the lockup slot. Printing plates can be clamped on the plate cylinders 14 of the printing couples 10, 11, 12 and 13, whereby each plate cylinder 14 comprises two lockup slots, namely a high lockup slot 18 and a low lockup slot 19. High lockup slots 18 are also designated as set-screw slots and low lockup slots 19 are also designated as oval-head-screw slots. In FIG. 1 the high lockup slots 18 are identified by a single line and the low lockup slots 19 by a double line. Viewed in the circumferential direction, two printing plates and, viewed in the axial direction, at least one printing plate can be clamped on the respective plate cylinder 14.

In the case of the satellite printing unit known from practice, according to FIG. 1, the transfer cylinders 15 of all printing couples 10 through 13 are aligned in such a way with the corresponding plate cylinders 14 of the printing couples 10 through 13 that, in the region of each printing couple 10, 11, 12 and 13, the lockup slot 17 of the transfer cylinder 15 rolls over the respective low lockup slot 19 of the plate cylinder 14. As a result, the impression cylinder 16 is ultimately subjected to a relatively high vibrational load, which can negatively impact the printing quality.

Figure 2:
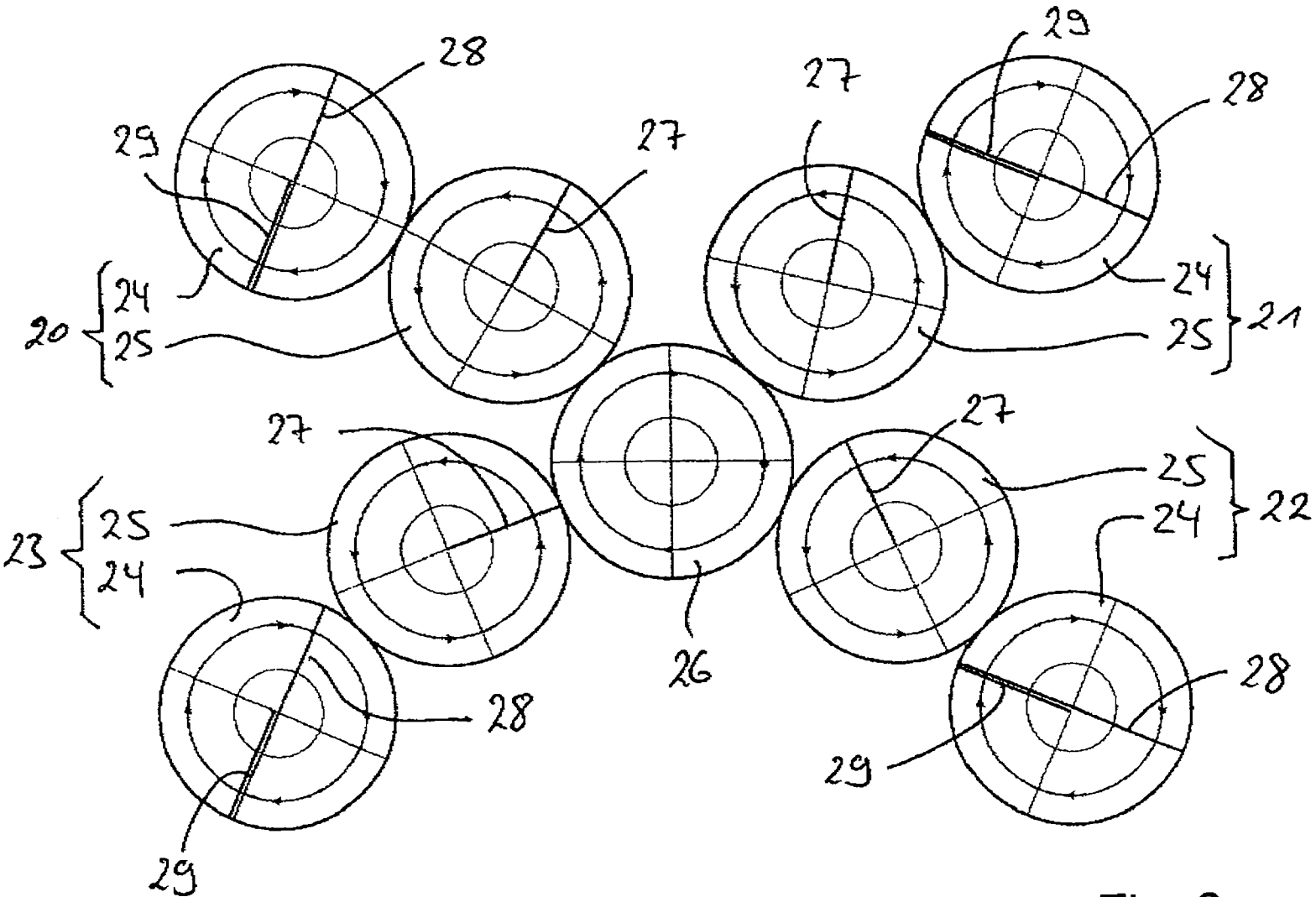
FIG. 2 illustrates an embodiment of a satellite printing unit of a web-fed rotary printing press in accordance with the principles of the present invention.

FIG. 2 shows an inventive satellite printing unit of a web-fed rotary printing press, whereby the satellite printing unit in FIG. 2 is comprised of four printing couples 20, 21, 22 and 23. Each printing couple 20, 21, 22 and 23 has a plate cylinder 24 as well as a transfer cylinder 25. All transfer cylinders 25 of the printing couples 20 through 23 roll off a common impression cylinder 26. In addition to the plate cylinders 24 and transfer cylinders 25, each of the printing couples 20 through 23 also include an inking system (not shown) as well as preferably a dampening system (also not shown).

Transfer plates can be clamped on the transfer cylinders 25 of the printing couples 20 through 23, wherein each transfer cylinder 25 includes a lockup slot 27 for this, so that, as viewed in the circumferential direction of the transfer cylinder 25, a transfer plate can be clamped on the circumference of the transfer cylinder. Printing plates can be clamped on the plate cylinders 24 of the printing couples 20 through 23, wherein each plate cylinder 24 has two lockup slots in approximately diametrically opposed circumferential positions, namely a high lockup slot 28 and a low lockup slot 29. Viewed in the circumferential direction of the plate cylinder 24, two printing plates can be clamped in succession in the lockup slots 28, 29. Viewed in the axial direction of the plate cylinders 24 or transfer cylinders 25, several printing plates or transfer plates can preferably be clamped.

In terms of the present invention, the transfer cylinders 25 of the printing couples 20 through 23 are aligned relative to the plate cylinders 24 of the printing couples in such a way that, on a first group of printing couples, which is comprised of at least one printing couple, the lockup slot 27 of the respective transfer cylinder 25 rolls over the high lockup slot 28 of the respective plate cylinder 24, and that, on a second group of printing couples, which is also comprised of at least one printing couple, the lockup slot 27 of the respective transfer cylinder 25 rolls over the low lockup slot 29 of the respective plate cylinder.

In the exemplary embodiment depicted in FIG. 2, the first group of printing couples, in which the lockup slot 27 of the respective transfer cylinder 25 rolls over the high lockup slot 28 of the respective plate cylinder 24, is comprised of two printing couples, namely printing couples 20 and 22 according to FIG. 2. The second group of printing couples, in which the lockup slot 27 of the respective transfer cylinder 25 rolls over the low lockup slot 29 of the respective plate cylinder 24, is also comprised of two printing couples in the exemplary embodiment in FIG. 2, namely printing couples 21 and 23.

As FIG. 2 shows, the transfer cylinders 27 of the two printing couples 20, 22 of the first group of printing couples and the transfer cylinders 27 of the two printing couples 21 and 23 of the second group of printing couples on the impression cylinder 26 are approximately diametrically opposed.

In contrast to the exemplary embodiment depicted in FIG. 2, it is also possible in terms of the present invention for the first group of printing couples, in which the lockup slot of the respective transfer cylinder rolls over the high lockup slot of the respective plate cylinder, to include only one single printing couple. In this case, the second group of printing couples, in which the lockup slot of the respective transfer cylinder rolls over the low lockup slot of the respective plate cylinder, is then comprised of three printing couples.

It is also possible for the first group of printing couples, in which the lockup slot of the respective transfer cylinder rolls over the high lockup slot of the respective plate cylinder, to include three printing couples. In this case, the second group of printing couples, in which the lockup slot of the respective transfer cylinder rolls over the low lockup slot of the respective plate cylinder, is then comprised of a single printing couple.

The high lockup slots 28 and well as the low lockup slots 29 of the plate cylinders 24 and the lockup slots 27 of the transfer cylinders 25 can extend on a respective circumferential position of the corresponding cylinders undivided over the entire axial width of the respective cylinder. This would mean that the lockup slot 27 of the transfer cylinder 25 extends on a circumferential position undivided over the entire axial width of the transfer cylinder 25. In just the same way, the high lockup slot 28 as well as the low lockup slot 29 would then extend on a circumferential position of the plate cylinder 24 over the entire axial width of the plate cylinder.

In contrast to this, it is also possible, however, for the high lockup slots 28 as well as the low lockup slots 29 of the plate cylinders 24 and the lockup slots 27 of the transfer cylinders 25 to be subdivided into several sections along the axial width of the respective cylinder.

It is therefore possible for the lockup slot 27 of each transfer cylinder 25 to be subdivided into two sections along the axial width of the transfer cylinder 25, wherein the two sections run in approximately diametrically opposed circumferential positions of the transfer cylinder 25. It is just as possible for the lockup slot 27 of the transfer cylinder 25 to be subdivided into three sections along the axial width of the transfer cylinder 25, wherein then preferably two sections are introduced to the transfer cylinder 25 at the same circumferential position and the other section at a circumferential position that is approximately diametrically opposed to this.

Then, when the lockup slots 27 of the transfer cylinders 25 are subdivided in the axial direction, the high lockup slots 28 as well as the low lockup slots 29 of the plate cylinders 24 are also subdivided in the axial direction, and namely in the same division ratio as the lockup slot 27 of the transfer cylinder 25, wherein the sections of the high lockup slot 28 and the low lockup slot 29 of the plate cylinder 24 formed by the division are arranged analogously to the sections of the lockup slot 27 of the transfer cylinder 25 at offset circumferential positions. This guarantees that, in the region of each printing couple 20 through 23, even with a divided lockup slot 27 of the transfer cylinder 25, whose sections are positioned at different circumferential positions, the sections of the high lockup slot 28 or the low lockup slot 29 corresponding to the sections of the lockup slot 27 roll over depending on to which group of printing couples the respective transfer cylinder is assigned.

LIST OF REFERENCE NUMERALS

10 Printing couple
11 Printing couple
12 Printing couple
13 Printing couple
14 Plate cylinder
15 Transfer cylinder
16 Impression cylinder
17 Lockup slot
18 High lockup slot
19 Low lockup slot
20 Printing couple
21 Printing couple
22 Printing couple
23 Printing couple
24 Plate cylinder
25 Transfer cylinder
26 Impression cylinder
27 Lockup slot
28 High lockup slot
29 Low lockup slot The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A satellite printing unit of a web-fed printing press, comprising four printing couples, wherein each printing couple is comprised of a plate cylinder, a transfer cylinder, an inking system and a dampening system, wherein each of the transfer cylinders of said respective printing couples rolls off a common impression cylinder to form a corresponding nip, wherein each plate cylinder features a high lockup slot and a low lockup slot, so that, as viewed in a circumferential direction, two printing plates can be clamped in succession on the respective plate cylinder, and wherein each transfer cylinder has a single lockup slot, so that, as viewed in the circumferential direction, a transfer plate can be clamped on the respective transfer cylinder, wherein the transfer cylinders of the printing couples are aligned relative to the plate cylinders of the printing couples in such a way that, on a first group of printing couples, which is comprised of at least one printing couple, the single lockup slot of the respective transfer cylinder is positioned to roll over the high lockup slot of the respective plate cylinder to produce a first vibration effect, and that, on a second group of printing couples, which is comprised of at least one printing couple, the single lockup slot of the respective transfer cylinder is positioned to rolls over the low lockup slot of the respective plate cylinder to produce a second vibration effect being different from the first vibration effect, such that the impression cylinder is excited to fewer vibrations as a result of an interaction of the first and second vibration effects, wherein each of the printing couples is assigned to exactly one of the first and second group of printing couples.

2. The satellite printing unit according to claim 1, wherein the first group of printing couples, in which the single lockup slot of the respective transfer cylinder rolls over the high lockup slot of the respective plate cylinder, is comprised of a single printing couple, and that the second group of printing couples, in which the single lockup slot of the respective transfer cylinder rolls over the low lockup slot of the respective plate cylinder, is comprised of three printing couples.

3. The satellite printing unit according to claim 1, wherein the first group of printing couples, in which the single lockup slot of the respective transfer cylinder rolls over the high lockup slot of the respective plate cylinder, is comprised of three printing couples, and that the second group of printing couples, in which the single lockup slot of the respective transfer cylinder rolls over the low lockup slot of the respective plate cylinder, is comprised of a single printing couple.

4. The satellite printing unit according to claim 1, wherein the first group of printing couples, in which the single lockup slot of the respective transfer cylinder rolls over the high lockup slot of the respective plate cylinder, is comprised of two printing couples, and that the second group of printing couples, in which the single lockup slot of the respective transfer cylinder rolls over the low lockup slot of the respective plate cylinder, is also comprised of two printing couples.

5. The satellite printing unit according to claim 4, wherein the transfer cylinders of the two printing couples of the first group of printing couples and the transfer cylinders of the two printing couples of the second group of printing couples are approximately diametrically opposed on the impression cylinder.

6. The satellite printing unit according to claim 1, wherein the high lockup slots as well as the low lockup slots of the plate cylinders and the single lockup slots of the transfer cylinders extend on a respective circumferential position undivided over an entire axial width of the respective cylinder.

7. The satellite printing unit according to claim 1, wherein the high lockup slots as well as the low lockup slots of the plate cylinders and the single lockup slots of the transfer cylinders are subdivided along an axial width of the respective cylinder.

8. A satellite printing unit of a web-fed printing press, comprising:

a first printing couple, including a first plate cylinder and a first transfer cylinder, wherein the first plate cylinder includes a high lockup slot and a low lockup slot, wherein the first transfer cylinder has a single lockup slot, and wherein the first transfer cylinder is aligned relative to the first plate cylinder such that the single lockup slot of the first transfer cylinder is positioned to roll over the high lockup slot of the first plate cylinder to produce a first vibration effect;

a second printing couple, including a second plate cylinder and a second transfer cylinder, wherein the second plate cylinder includes a high lockup slot and a low lockup slot, wherein the second transfer cylinder has a single lockup slot, and wherein the second transfer cylinder is aligned relative to the second plate cylinder such that the single lockup slot of the second transfer cylinder is positioned to roll over the low lockup slot of the second plate cylinder to produce a second vibration effect being different from the first vibration effect; and an impression cylinder, wherein the first and second transfer cylinders roll on the impression cylinder such that the impression cylinder is excited to fewer vibrations as a result of an interaction of the first and second vibration effects.

9. A method of reducing vibrations in a satellite printing unit of a web-fed printing press, wherein the satellite printing unit includes:

a first printing couple, including a first plate cylinder and a first transfer cylinder, wherein the first plate cylinder includes a high lockup slot and a low lockup slot and wherein the first transfer cylinder has a single lockup slot;

a second printing couple, including a second plate cylinder and a second transfer cylinder, wherein the second plate cylinder includes a high lockup slot and a low lockup slot and wherein the second transfer cylinder has a single lockup slot; and an impression cylinder;

the method comprising the steps of:

rolling the first transfer cylinder on the first plate cylinder such that the single lockup slot of the first transfer cylinder rolls over the high lockup slot of the first plate cylinder to produce a first vibration effect;

rolling the second transfer cylinder on the second plate cylinder such that the single lockup slot of the second transfer cylinder rolls over the low lockup slot of the second plate cylinder to produce a second vibration effect being different from the first vibration effect; and rolling the first and second transfer cylinders on the impression cylinder such that the impression cylinder is excited to fewer vibrations as a result of an interaction of the first and second vibration effects.

* * * * *